US006719044B2

(12) United States Patent
Ford et al.

(10) Patent No.: US 6,719,044 B2
(45) Date of Patent: Apr. 13, 2004

(54) WEAR BUSHING RUNNING AND RETRIEVAL TOOLS

(75) Inventors: David L. Ford, Katy, TX (US); Kevin R. Koen, Cypress, TX (US); Fergus Coutts Hines, Houston, TX (US)

(73) Assignee: ABB Vetco Gray Inc., Houston, TX (US)

( * ) Notice: Subject to any disclaimer, the term of this patent is extended or adjusted under 35 U.S.C. 154(b) by 262 days.

(21) Appl. No.: 09/802,085

(22) Filed: Mar. 8, 2001

(65) Prior Publication Data

US 2002/0092656 A1 Jul. 18, 2002

Related U.S. Application Data

(60) Provisional application No. 60/192,658, filed on Mar. 28, 2000.

(51) Int. Cl.[7] ..... E21B 23/03

(52) U.S. Cl. ..... 166/85.3; 166/381; 166/85.1; 166/98; 166/301; 294/86.24; 294/86.14

(58) Field of Search ..... 166/85.3, 85.1, 166/377, 381, 98, 301; 294/86.1, 86.14, 86.15, 86.24, 86.26, 86.28, 86.32, 86.33, 86.17

(56) References Cited

U.S. PATENT DOCUMENTS

| | | | | |
|---|---|---|---|---|
| 2,234,438 A | * | 3/1941 | Kothny | 294/86.14 |
| 2,261,393 A | * | 11/1941 | Kothny | 294/86.15 |
| 2,298,706 A | * | 10/1942 | Kothny | 166/255.3 |
| 2,302,330 A | * | 11/1942 | Kothny | 294/86.15 |
| 2,454,839 A | * | 11/1948 | Ring | 294/86.2 |
| 3,247,914 A | | 4/1966 | Slack | |
| 3,473,608 A | * | 10/1969 | Castille | 166/85.3 |
| 3,489,214 A | | 1/1970 | Phipps et al. | |
| 4,362,210 A | | 12/1982 | Green | |
| 4,625,381 A | | 12/1986 | Gravouia, Jr. et al. | |
| 4,978,147 A | | 12/1990 | Henderson, Jr. et al. | |
| 4,995,458 A | | 2/1991 | Garbett | |
| 5,025,864 A | | 6/1991 | Nobileau | |
| 5,199,495 A | | 4/1993 | Brammer et al. | |
| 5,360,063 A | | 11/1994 | Henderson, Jr. | |
| 5,762,136 A | | 6/1998 | Oswald | |

* cited by examiner

*Primary Examiner*—David Bagnell
*Assistant Examiner*—Giovanna Collins
(74) *Attorney, Agent, or Firm*—Bracewell & Patterson, L.L.P.

(57) ABSTRACT

Devices and methods for selectively emplacing a wear bushing in a wellhead housing and removing it therefrom. A drill string-mounted running tool is used to selectively engage the wear bushing during emplacement and removal. The wear bushing need not be removed each time the drill string is tripped into or out of the well. In addition, the drill string may continue to be lowered after the wear bushing is landed since the running tools described can easily pass through the bushing.

8 Claims, 8 Drawing Sheets

WEAR BUSHING RUNNING AND RETRIEVAL TOOLS

This application claims the priority of provisional application No. 60/192,658 filed Mar. 28, 2000.

BACKGROUND OF THE INVENTION

1. Field of the Invention

The present invention relates to devices and methods for running a wear bushing into and retrieving a wear bushing from a well.

2. Description of the Related Art

Wear bushings, or wear sleeves, are used to protect the interior of the wellhead during drilling. A typical wear bushing is landed in the wellhead housing before the bit is run into the well. The wear bushing is then removed after drilling and before the well is lined with casing. Traditionally, separate trips with a running tool and, later, a retrieval tool were required to emplace and them retrieve the wear bushing. An example of this type of system is described in U.S. Pat. No. 5,762,136 issued to Oswald. Unfortunately, the extra trips for the running tool are costly and time consuming.

There are a few systems known that have attempted to couple the operations of running and retrieving the wear bushing with those of running and retrieving the drill bit from the wellbore. Unfortunately, these systems do not, in practice, provide workable solution.

U.S. Pat. No. 3,247,914 issued to Slack describes a technique wherein a wear bushing protector loosely surrounds the drilling string. The diameter of the drill bit is larger than the inside diameter of the protector allowing the protector to be carried top the drill bit for loose placement into and removal from the wellhead housing. However, this sort of arrangement is impractical today since it is preferred to pass a drill bit through the wear bushing during use, and the diameter of drill bits used is smaller than the interior of the wear bushing.

U.S. Pat. No. 3,489,214 issued to Phipps describes a system wherein a wear sleeve also located on a drill collar above the drill bit for placement in a wellhead. The wear sleeve is provided with interior J-slots that can be engaged by pins on the drill collar. If it is desired to retrieve the wear sleeve without bringing the drill bit all the way up and out of the hole, a specialized retriever tool is incorporated into the drill string. The wear sleeve can then be retrieved by lowering the retriever tool down to the level of the wear sleeve and engaging the J-slots of the wear sleeve with pins on the retriever tool. While this type of arrangement is effective, it requires the drill string to be broken down in order to incorporate the retriever tool into the drill string. After the wear sleeve is removed from the well, the drill string must be broken down a second time to remove the wear sleeve and the retriever tool. A further problem with this design is that the downward movement of the drill string is limited by the wear sleeve. The retriever tool cannot pass through the wear sleeve because the outwardly projecting pins and rings prevent passage. If it is desired to advance the drill bit downhole, one must pull the drill string out and break it down to remove the retriever tool.

U.S. Pat. No. 4,625,381 issued to Gravouia, Jr. et al. also describes a system wherein a wear bushing can be retrieved using a retriever section with J-slots. This system suffers from substantially the same drawbacks as the Phipps system U.S. Pat. No. 4,362,210 issued to Green describes a friction hold wear bushing. A wrench is rotated to cause the specialized wear bushing to selectively engage the casing in a frictional grip.

U.S. Pat. No. 4,995,458 issued to Garbett describes wear bushing retrieval arrangements wherein a latching device is secured to the outside of a length of casing during a late stage of the casing running operation. The latching device engages a groove on the interior of the wear bushing. The wear bushing can then be removed from the wellhead casing by pulling upward on the casing string. It is noted that Garbett's system involves actually drilling through the wear bushing at the start of drilling.

The prior art arrangements have a number of operational problems. In systems such as those described in Garbett, once the wear bushing has been landed, the drill string cannot be readily moved downwardly further into the wellbore because progress of the retrieval tool becomes blocked by the wear bushing. On the other hand, systems such as those taught in Slack remove the wear bushing every time the bit is removed from the wellbore. This is undesirable. Phipps system requires that the drill string be disassembled to incorporate the retriever tool. Additionally, many prior art techniques do not provide a means for securing the wear bushing to the drill string for running the wear bushing. It would be desirable to have devices and methods that address the problems of the prior art.

SUMMARY OF THE INVENTION

Arrangements are described wherein wear bushing can be selectively emplaced in a wellhead housing or removed therefrom. A running tool is used to selectively engage the wear bushing during emplacement and removal. The wear bushing need not be removed each time the drill string is tripped into or out of the well. In addition, the drill string may continue to be lowered after the wear bushing is landed since the running tools described can easily pass through the bushing. Further, the drill string need not be broken down in order to incorporate the running tools.

In a first exemplary embodiment, a running tool is incorporated into the drill string at the outset of drilling operations and provided with a radially expandable C-ring that engages an inner portion of the wear bushing as the drill string is tripped in. Once the wear bushing is landed in the wellhead housing, the C-ring is cammed radially inwardly as the drill string and running tool are disposed further downhole. The drill string and bit may be removed from the well by simply pulling them directly out of the well. If it is desired to remove the wear bushing, such as after a portion of the drilling is completed, this may be accomplished without completely tripping the bit out of the well. The C-ring of the running tool is moved to a radially expanded position by disposing a dart, plug or wiper into the flowbore of the drill string and providing fluid pressure inside the flowbore. The drill string is then moved upwardly to the point that the C-ring engages the wear bushing. Tripping out of the drill string from the well to the point that the running tool is removed will remove the wear bushing as well.

In a second described embodiment, spring-based locking pins that selectively project radially outwardly are used in place of a radially expandable C-ring. The pins initially engage the wear bushing and carry it upon the drill string as the bit is run into the well. After the wear bushing is landed, and the bit disposed lower into the well, the pins are retracted radially and retained in that configuration. As a result, the drill string and bit may be removed from the well without removing the wear bushing. Fluid pressurization within the flowbore of the drill string will cause the pins to expand radially so that the wear bushing may be engaged by the running tool. The wear bushing may then be removed from the well by removing the drill string and running tool from the well.

In a third described embodiment, the drill string is selectively secured to a wear bushing by locking pins that are caused to selectively project radially outwardly from the running tool. The drill string is also secured by a "weak" C-ring arrangement to a locking assembly having a set of locking dogs that engage the wellhead. After the wear bushing is seated in the wellhead housing, weight is placed upon the drill string to release the drill string from the locking assembly and the wear bushing.

DETAILED DESCRIPTION OF PREFERRED EMBODIMENTS

Figure 1:
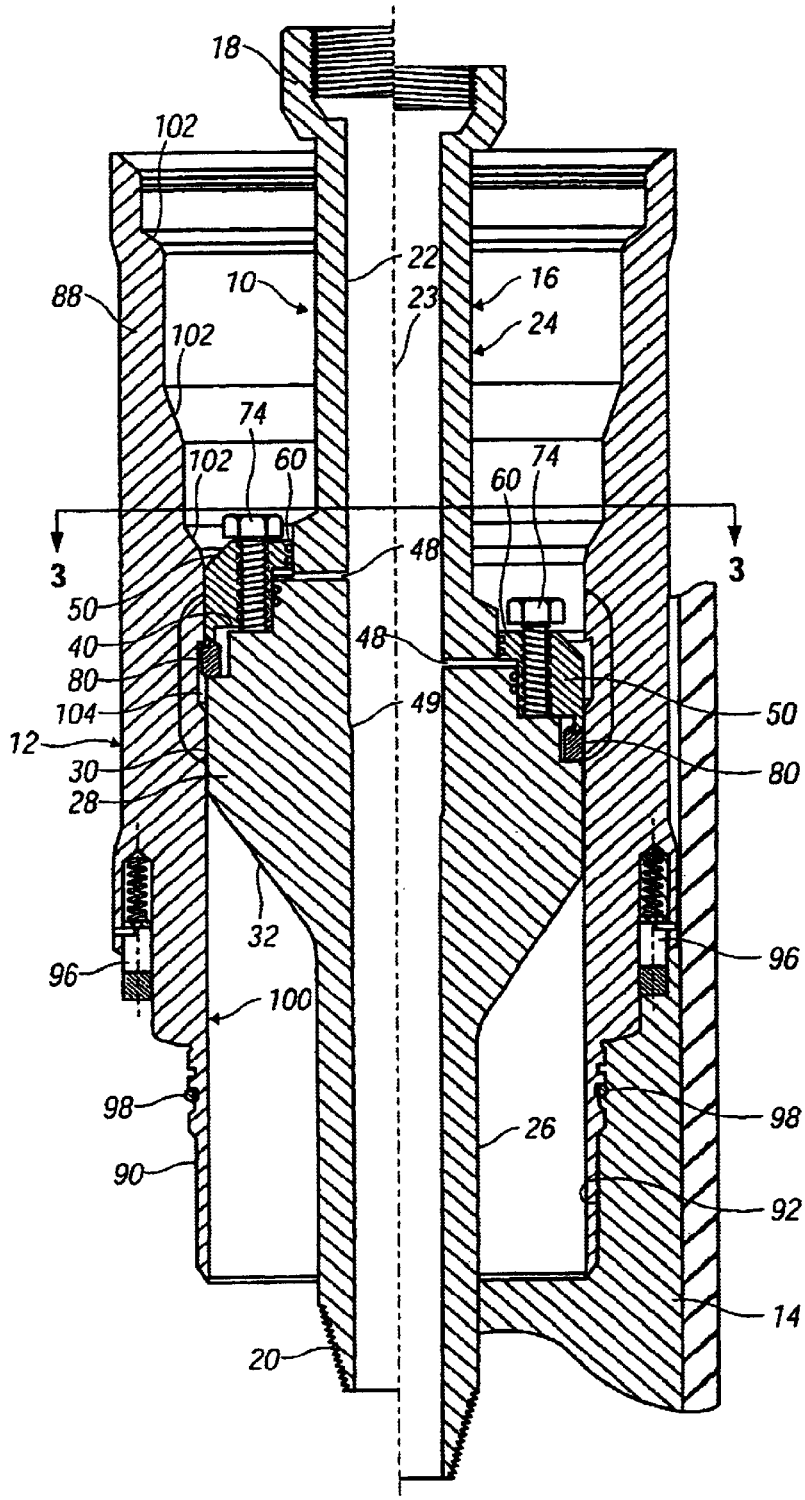
FIG. 1 is a side cross-sectional view of a first exemplary wear bushing running and retrieving tool with a surrounding wear bushing wherein the left side of the view depicts the tool in a first operational position, and the right side of the view depicts the tool in a second operational position.
Figure 2:
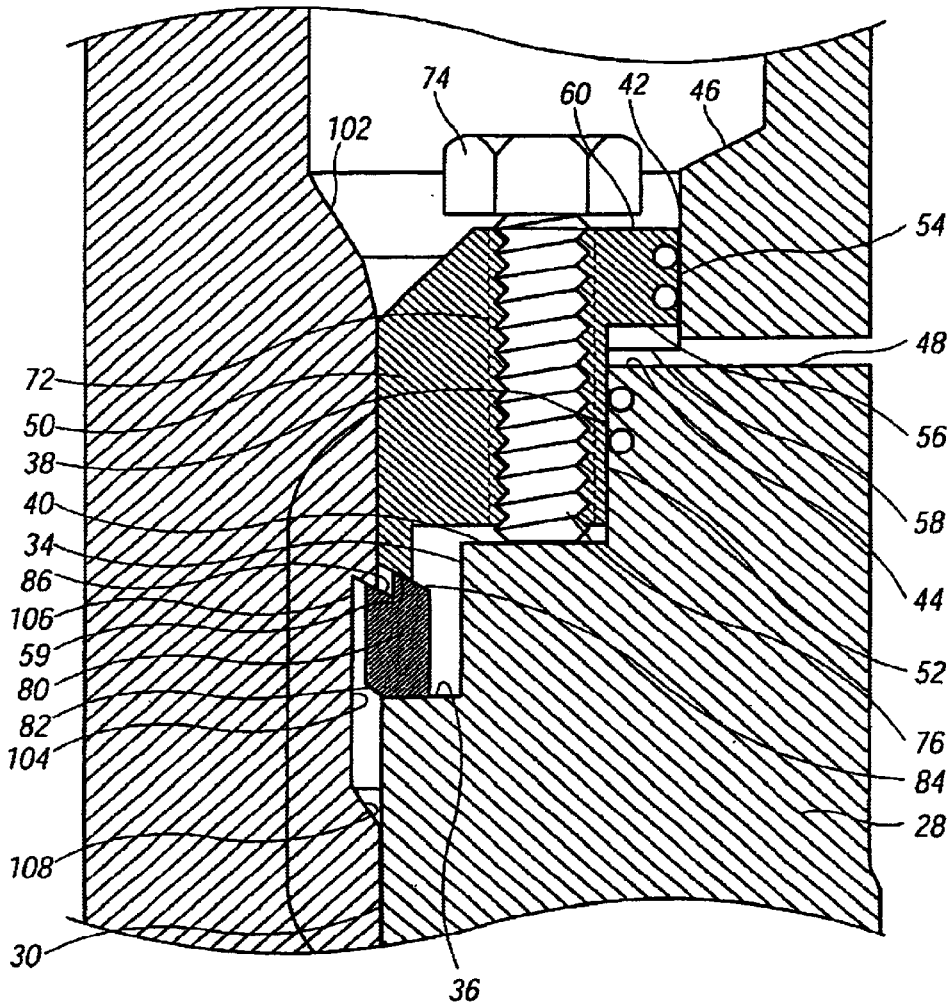
FIG. 2 is a close-up cross-sectional view of portions of the collar and hex bolts used with the running and receiving tool shown in FIG. 1.
Figure 3:
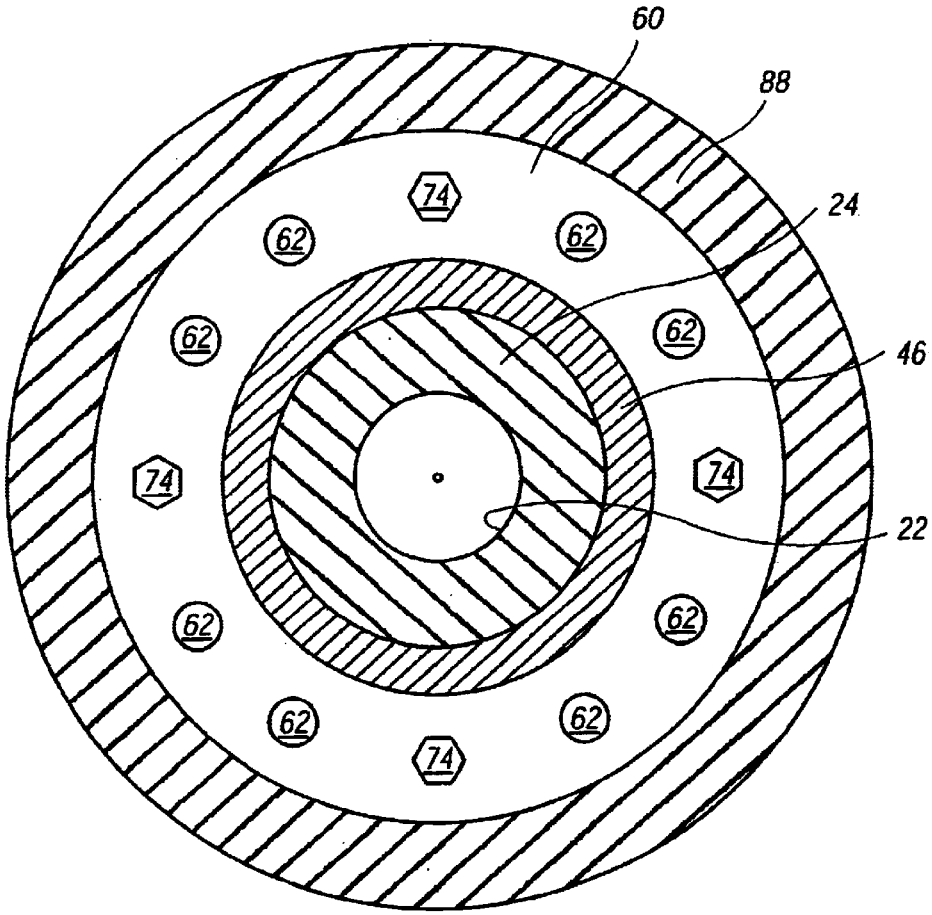
FIG. 3 is a plan cross-sectional view of the running and receiving tool and wear bushing taken along lines 3—3 in FIG. 1.

Referring first to FIGS. 1–3, there is generally shown a first exemplary embodiment for a running tool 10 that is used for placing a wear bushing 12 into and removing it from a casing hanger, generally shown at 14 (see right side of FIG. 1). The tool 10 permits the wear bushing 12 to be selectively placed within the casing hanger 14 while tripping into the hole with a drill bit (not shown). Normally, the casing hanger 14 will be landed in a wellhead housing located at a subsea floor. The drilling rig will be on a floating platform, and the sea depth may be thousands of feet deep.

The tool 10 comprises a generally tubular tool body 16 that can be incorporated into a conventional drill string (not shown). As shown in FIGS. 1–2, the tool body 16 is provided with a box-type threaded connector 18 at the upper end and a pin type threaded connector 20 at the lower end. These connectors can be affixed to mating portions of a drill string so that the tool 10 is essentially a sub in the string. As will be understood by those of skill in the art, a drill bit and bottom hole assembly (not shown) are disposed below the tool 10 in the string. The tool body 16 defines a central flowbore 22 along its longitudinal axis 23 and has upper and lower reduced exterior diameter portions 24, 26.

The tool 10 also has an enlarged portion 28 located between the two reduced diameter portions 24, 26. It is noted that the outer diameter of the enlarged portion 28 is sized so that is may axially pass entirely through the interior of the wear bushing 12. The enlarged portion 28 presents an enlarged radially outward-facing cylindrical surface 30. A downwardly tapered surface 32 interconnects the surface 30 to the lower portion 26. A first intermediate-diameter cylindrical outward-facing surface 34 (shown in FIG. 2) is located directly above the enlarged surface 30, and an upwardly facing stop shoulder 36 (also shown in FIG. 2) is defined between the two. A second intermediate-diameter cylindrical outward-facing surface 38 (see FIG. 2) is located above the first intermediate-diameter surface 34. An upwardly facing engagement face 40 is defined between the two. Vertical face 42 is located above the second intermediate-diameter face 38, and horizontal upward-facing surface 44 (see FIG. 2) is defined between the vertical faces 38, 42. Tapered face 46 is located above the vertical face 42.

One or more fluid communication ports 48 are disposed through the body 16 to permit fluid, such as drilling fluid to be transmitted between the bore 22 and the outside of the tool 10 proximate the upward-facing surface 44. An upward-facing shoulder 49 is located within the flowbore 22 below the fluid communication ports 48.

An annular collar 50 radially surrounds the tool body 16 and is shaped and sized to fit in a complimentary manner atop the enlarged portion 28 of the tool 10. The collar 50 provides vertical-inward cylindrical faces 52 and 54 (see FIG. 2) that abut and engage the vertical faces 38, 42 of the tool body 16, respectively. Downward facing surface 56 (see FIG. 2) is shaped to face the upward-facing surface 44 of the tool body 16. A fluid chamber 58 (visible in FIG. 2) is formed between the surfaces 40, 56, 42 and 52. O-ring seals seal between faces 42 and 54 as well as 38 and 52. Collar 50 has a depending leg 59 (see FIG. 2).

Figure 4:
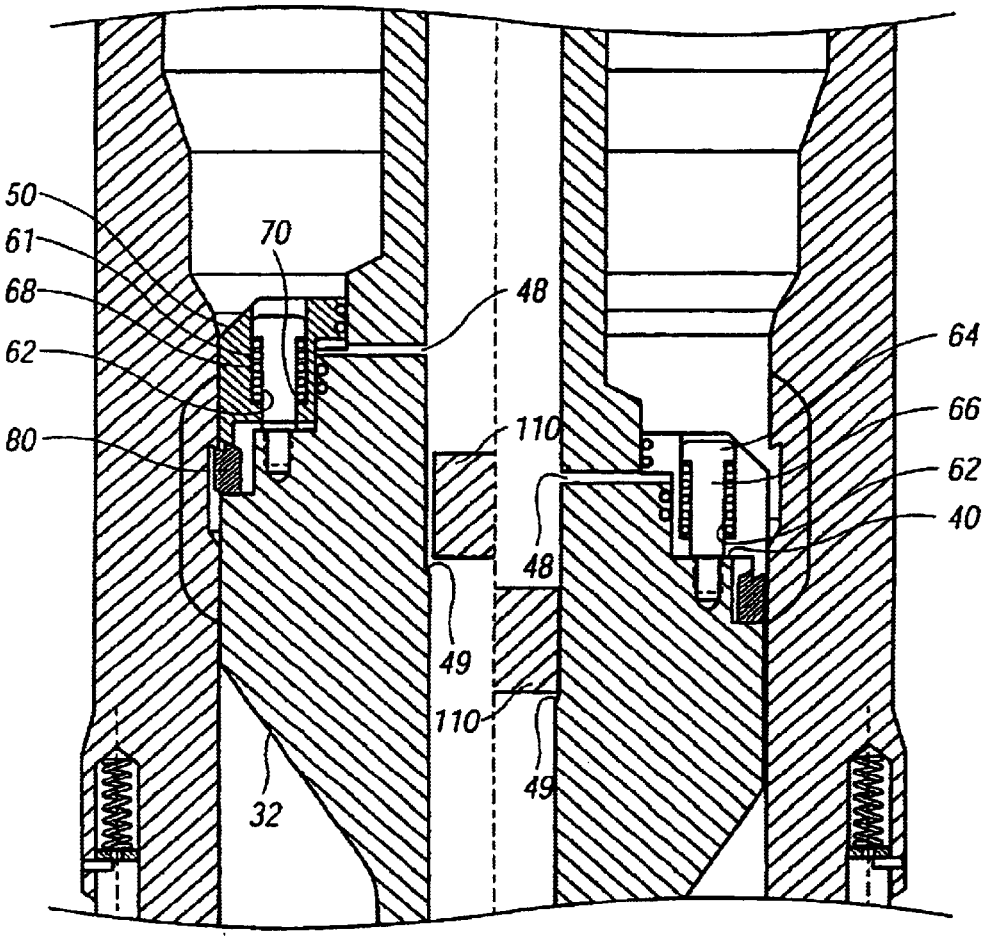
FIG. 4 is a side view of the tool and bushing shown in FIG. 1. The left side of the view depicts the tool in a third operational position, and the right side of the view depicts the tool in a fourth operational position.

FIG. 4 depicts the tool 10 as viewed from a slightly different angle than the side cross-sectional view of FIG. 1. This is done in order to illustrate pins and springs which are not visible in FIG. 1. As can be seen, the collar 50 has a upper face 60 through which a number of apertures 61 (visible in FIG. 4) are drilled to pass entirely through the collar 50. The collar 50 is affixed to the tool body 16 by a plurality of securing pins 62 which are visible in FIG. 4. The securing pins 62 have an enlarged head 64 and a reduced diameter longitudinal body 66. The pins 62 are disposed in apertures 61, and the lower end of the body 66 of each pin 62 is then anchored into the surface 40 of the tool body 16. It is noted that compressible springs 68 also reside within the apertures 61 and radially surround the body 66 of each pin 62 so as to engage the enlarged head 64 and a radial shoulder 70 within the apertures 61. As a result of this arrangement, the collar 50 is biased axially downwardly toward engagement with the upward facing surface 40 by the springs 68.

In addition to the apertures 61, there are a number of bolt holes 72 (see FIG. 2) also disposed through the upper face 60 of the collar 50. Within these bolt holes 72, hex bolts 74 are threadedly inserted. The plan cross-sectional view of FIG. 3 illustrates an exemplary layout for the hex bolts 74 and pins 62.

It is noted that the hex bolts 74 have a shank 76 that is slightly longer than the length of the bolt hole 72. Therefore, fully inserting the hex bolt 74 into the bolt hole 72 will urge the collar 50 away from the upward facing surface 40 and compress the springs 68.

Referring again to FIG. 2, a C-ring 80 is carried on the upward facing surface 36 of the tool body 16 and is located below the collar 50. The C-ring 80 is outwardly biased so that it will tend to expand radially when not restrained. The C-ring 80 has an outwardly and downwardly tapered surface 82 (best shown in FIG. 2) at its lower end. The upper end of the C-ring 80 presents an upwardly and inwardly tapered surface 84. An upward facing recess 86 is located radially outwardly from that surface 84, providing a generally saw-tooth configuration on the upper side of C-ring 80. Leg 59 of collar 50 is adapted to engage C-ring 80 to hold it in a retracted position.

In the configurations shown in FIGS. 1–4, the wear bushing 12 radially surrounds and is carried upon the tool 10. The wear bushing 12 is made up of a generally cylindrical body 88 with an outer surface 90 that is shaped to reside within the inner profile 92 of the casing hanger 14.

Anti-rotation members 96, of a type known in the art, are disposed within the body 88 of the bushing 12. The anti-rotation members 96 comprise downward protruding pins that engage mating recesses (not shown) in the casing hanger 14 to help prevent the bushing 12 from being rotated with respect to the hanger 14 after being landed therein. One or more elastomeric seals 98 surround the lower end of the bushing 12 to ensure a fluid tight seal with the hanger 14. The radial inner surface 100 of the bushing 12 has a series of shoulders 102. In addition, the inner surface 100 carries an annular recess 104 which has a downwardly protruding rim 106 at its upper end (see FIG. 2). An upward facing camming surface 108 is located at the lower end of the recess 104.

The left half of FIG. 1 illustrates the tool 10 in a first position which is representative of the configuration the tool 10 would be placed in when it is made up on the rig floor before running. The hex bolts 74 have been fully inserted into the bolt holes 72 so that the collar 50 is urged away from the upward facing surface 40 of the tool body 16. As a result, the C-ring 80 is allowed to radially expand. In this condition, the annular recess 86 of the C-ring 80 engages the downward protrusion 106 of the recess 104 to secure the wear bushing 12 onto the enlarged portion 28 of the tool body 16. With the wear bushing 12 so secured, the hex bolts 74 are then backed out of the bolt holes 72 so that the lower end of the shanks 76 of the hex bolts 74 do not contact the upwardly facing surface 40 of the tool body 16. This allows axial movement of collar 50 relative to tool body 16.

Tool 10 is then run into the well along with wear bushing 12 and with a drill bit on the lower end of the drill string. The right half of FIG. 1 illustrates the tool 10 in a second position in which the wear bushing 12 has been landed in the casing hanger 14. Sufficient load has been applied to the upper end of the drill string to set the locking ring (not shown) of the wear bushing 12. The locking ring snaps into a recess in casing hanger 14, preventing upward movement. The drill string, containing tool body 16 is being lowered further in the wellbore so that the drill bit at its lower end (not shown) may be used to drill in the formation. As can be seen, the C-ring 80 has been moved below the rim 106 and has been cammed radially inwardly by the upward camming surface 108 thereby allowing the enlarged portion 28 of the tool body 16 to be moved downwardly within the casing hanger 14. This occurs because once wear bushing 12 lands, tool 10 is able to move downward relative to wear bushing 12. When cammed upward, springs 68 (FIG. 4) push collar 50 downward, causing leg 59 to engage recess 86, retaining C-ring 80 in a retracted position.

The wear bushing 12 need not be removed from the casing hanger 14 each time the drill string is tripped. The operator can select to remove wear bushing 12 only when that portion of the drilling is completed. When it is not desired to retrieve wear bushing 12, tool 10 will simply pass through wear bushing 12 each time the drill string is tripped. Since collar 50 holds C-ring 80 in the retracted position, C-ring 80 will not engage recess 104 of wear bushing 12. When it is desired to retrieve wear bushing 12, the drill string is pulled upward until the enlarged portion 28 of the tool body 16 is located generally above the wear bushing 12. A dart, plug or wiper, shown generally at 110 in FIG. 4, is dropped into the flowbore 22 to land on shoulder 49 in the flowbore 22, thereby blocking fluid flow through the flowbore 22. If desired, the dart, plug or wiper 110 can be run into the flowbore 22 on a wireline so that it can be easily retrieved. Fluid pressure is increased within the flowbore 22 above the dart 110. The presence of the dart 110 causes fluid to be transmitted along the hydraulic ports 48 and into chamber 58 as pressure is increased at the top of the wellbore. As a result, the collar 50 is urged upwardly away from the upward facing surface 40. This releases the C-ring 80 for outward radial expansion.

The drill string is then lowered downwardly so that the enlarged portion 28 of the tool body 16 enters the wear bushing 12. C-ring 80 will expand radially once it encounters the recess 104 in the inner surface 100 of the wear bushing 12. When the C-ring 80 expands in this manner, it will be understood that the wear bushing 12 is once again secured to the tool body 16 with C-ring 80 engaging shoulder 106. The operator of the drill string will likely have an indication that the wear bushing 12 is secured by receipt of an increased load weight on the drill string when picking up. At this point, fluid pressure within the flowbore 22 above the dart 110 can be reduced. The wear bushing 12 can now be removed from the casing hanger 14 by pulling upward on the drill string.

Figure 5:
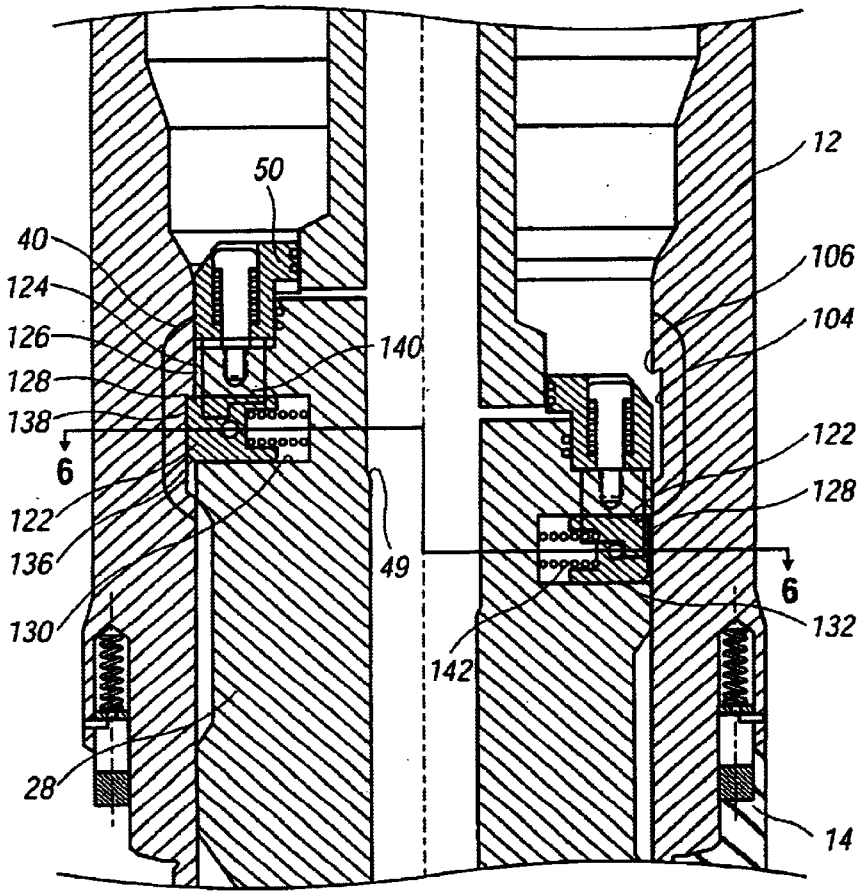
FIG. 5 is a side view of a second exemplary wear bushing running and retrieving tool with a surrounding wear bushing. The left side of the view depicts the tool in a first operational position, and the right side of the view depicts the tool in a second operational position.

Referring now to FIG. 5, an alternative embodiment for a wear bushing running and retrieval tool 120 is depicted. Construction and operation of the alternative tool 120 is much the same as the first tool 10 described previously. As a result, like reference numerals are used for like components. Unlike the tool 10, the alternative tool 120 utilizes spring-biased locking pins 122 rather than the C-ring 80 for securement of the wear bushing 12 to the tool body 16. The tool body 16 is modified by cutting away edge portions to create a radial space 124 below the upward-facing surface 40. The collar 50 additionally has a number of downwardly projecting fingers 126 that are disposed within the radial spaces 124. The lower end of the fingers 126 have shaped end portions 128.

Figure 6:
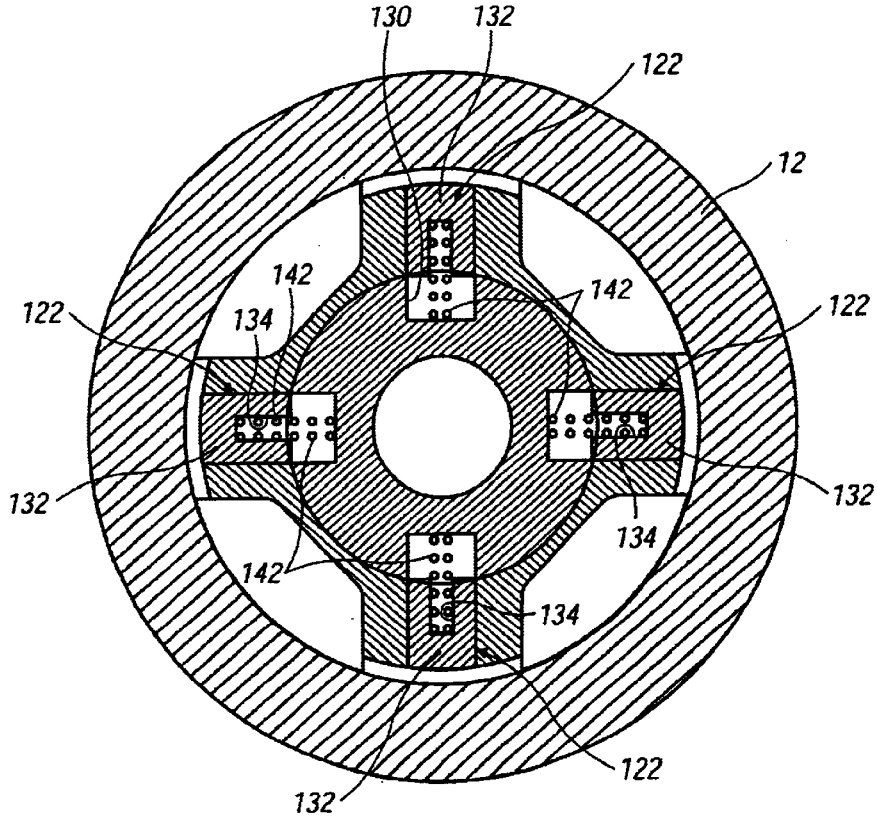
FIG. 6 is a plan cross-sectional view of the tool shown in FIG. 5 taken along lines 6—6.

Locking pins 122 are disposed in pin recesses 130 that have been cut or drilled radially into the enlarged portion 28 of the tool body 16. There are preferably four such pins 122, as illustrated in the plan cut away view of FIG. 6. The pins 122 each have a substantially cylindrical body 132 with a blind bore 134 cut into one axial end. The other axial end of the pin 122 has a lower camming shoulder 136 and an upper projecting ridge 138. The upper surface of the pin 122 carries a depression 140 located radially inwardly of the ridge 138. Compressive springs 142 are disposed within the blind bores 134 of each pin 122 and engage the inner ends of the pin recesses 130.

It is pointed out, with reference to the right hand side of FIG. 5 that the shaped end portion 128 of each of the downwardly projecting fingers 126 is formed to engage and reside within the complimentary depression 140 on the upper surface of an aligned locking pin 122 below, thereby maintaining pin 122 radially withdrawn inside of its pin recess 130. Therefore, when the collar 50 is moved downwardly to engage the upward facing surface 40 of the enlarged portion 28, the pins 122 are secured in a radially inward position wherein they are disposed substantially within the pin recesses 130. When the collar 50 is raised with respect to the enlarged portion 28, the shaped end portions 128 are removed from the recesses 140 and the pins 122 are freed to move radially outwardly from the enlarged portion 28 by urging of the springs 142. It should be recognized that the upper projecting ridges 138 of the pins 122 are shaped to engage the rim 106 of the recess 104 in the wear bushing 12 when the pins 122 are radially extended from the enlarged portion 28. Thus, when the pins 122 are so extended, the wear bushing 12 can be secured onto the tool body 16 by engagement of the pins 122 with the rim 106.

Operation of this alternative tool arrangement will be essentially the same as that described for the tool 10 described previously. The wear bushing 12 is affixed to the tool 10 by configuring the tool 10 and wear bushing 12 as shown on the left side of FIG. 5 so that the pins 122 engage the rim 106. The hex bolts 74 have been backed off of their fully inserted position to allow the collar 50 to be moveable in response to increase fluid pressure within the fluid chamber 58.

The wear bushing 12 is then landed in the casing hanger 14, as shown in the right hand side of FIG. 5 by lowering the drill string within the borehole. Sufficient load is applied to the upper end of the drill string to set the locking ring (not shown) of the wear bushing 14. The drill string, containing tool body 16, is then lowered further in the wellbore so that the drill bit at its lower end (not shown) may be used to drill in the formation. The locking pins 122 have been moved below the rim 106 (see right side of FIG. 5) and are cammed radially inwardly by the upward camming surface 108 thereby allowing the enlarged portion 28 of the tool body 16 to be moved downwardly within the casing hanger 14.

The wear bushing 12 need not be retrieved with each trip of the drill string out of the well. If it is desired, for whatever reason, to remove the drill string and still leave the wear bushing 12 in place, the drill string is simply pulled upwardly and out of the hole. The pins 122 will remain secured in a radially inward position by the collar 50 and, thus, do not present any impediment to removal of the tool 120 from the wear bushing 12.

To remove the wear bushing 12 from the casing hanger 14, the drill string is again picked up until the enlarged portion 28 of the tool body 16 is located generally above the wear bushing 12. A dart, plug or wiper (not shown) is dropped into the flowbore 22 to land on shoulder 49, and fluid pressure is increased within the flowbore 22, as described above to raise the collar 50 off of the surface 40 and free the pins 122 for radially outward movement, as urged by the springs 142.

The drill string is then lowered downwardly so that the enlarged portion 28 of the tool body 16 enters the wear bushing 12. The pins 122 will expand radially outward once they encounter the recess 104 in the inner surface 100 of the wear bushing 12. When the pins 122 expand outwardly in this manner, it will be understood that the wear bushing 12 is once again secured to the tool body 16 and can be removed from the casing hanger 14 by pulling upward on the drill string. The fluid pressure may be removed.

Figure 7:
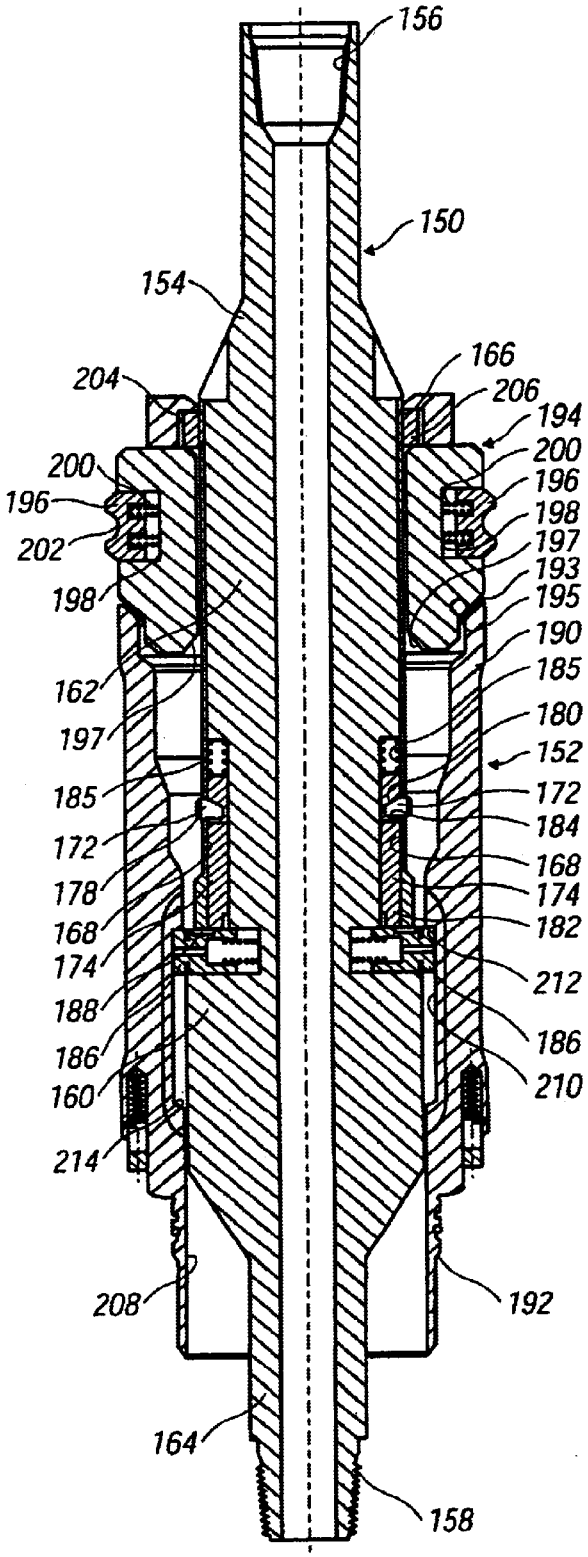
FIG. 7 is a side cross-sectional view of a further alternative exemplary tool and wear bushing.

FIG. 7 depicts a further alternative embodiment of a wear bushing running and receiving tool 150 which relies upon mechanical manipulation rather than hydraulic actuation to cause the too 150 to operate to run and remove wear bushing 152. In this respect, the tool 150 is substantially different in construction and operation from those previously described.

The tool 150 has a generally cylindrical body 154 with a box-type threaded connector 156 at the upper end, and a pin-type threaded connector 158 at the lower end. The tool body 154 has an enlarged central section 160 with upper and lower reduced diameter portions 162, 164 on either side.

The upper reduced diameter portion 162 provides an outwardly-facing annular recess 166. Inside the outer radial periphery of the upper reduced diameter portion 162, a number of longitudinal shafts 168 (two shown) are disposed which carry trigger pins 172. Dog capture pins 174 are disposed in the shafts 168 just below the trigger pins 172. The dog capture pins 174 are capable of longitudinal movement within the shafts 168.

The trigger pins 172 each have a lower camming surface 178 and an upper, inwardly-directed camming surface 180. The dog capture pins 174 each have a shaped lower end 182 and an upper engagement face 184 that is shaped and sized to engage the trigger pins 172. The dog capture pins 174 are each secured to a compressible coil spring 185 that is disposed within the shaft 168. Although not apparent from FIG. 7, it will be understood that the dog capture pins 174 are continuous members that extend from the spring 185 downward to their lower ends 182. Although the trigger pins 172 are retained along their lengths, the dog capture pins 174 are not separated by the trigger pins 172.

The tool body 154 retains a plurality of spring biased locking pins 186 that are similar to the locking pins 122 described earlier with respect to the running and retrieving tool 120 described earlier. The upper surface of each locking pin 186 provides a recess 188 that is shaped and sized to receive the shaped lower end 182 of the dog capture pin 174 disposed above it. Each of the compressible springs 185 urge their respective dog capture pin 174 downwardly within its shaft 168 into engagement with the recess 188 of a locking pin 186 thereby helping to ensure that the locking pins 186 are secured in a radially inward position.

The wear bushing 152 that is run and retrieved by the tool 150 is also shown and described in some detail, as its construction is useful for operation of the running and receiving tool 150. The wear bushing 152 has a main housing 190 that presents an outer, lower profile 192 shaped and sized to reside within the profile of a casing hanger, such as casing hanger 14. The wear bushing 152 also has an upper locking assembly 194 that carries locking dogs 196 used for securing the wear bushing 152 within a wellhead. The locking dogs 196 are retained within recesses 198 in the upper portion of the housing 190 and are outwardly biased from those recesses 198 by compressive springs 200.

The upper locking assembly 194 is not affixed to the housing 190. Instead, the locking assembly 194 provides an outwardly-directed shoulder 193 that is shaped and sized to be seated upon inwardly-directed shoulder 195 on the housing 190. The locking assembly 194 also presents an inwardly-directed shoulder 197 at its lower end. It is noted that the outer radial surface 202 of each of the locking dogs 196 of the locking assembly 194 is shaped with a series of ridges and valleys that are complimentary to the shape of an engaging profile in the wellhead (not shown).

The upper end of the upper locking assembly 194 of the wear bushing 152 also has a radially inward-facing recess 204 that retains a C-ring 206 that is biased radially inwardly through shape memory. The inner surface 208 of the wear bushing 152 has an annular recess 210 similar to the recesses 104 described earlier, having both an upper rim 212 and a lower camming surface 214.

Prior to running the drill string, the tool 150 and wear bushing 152 are secured to one another, as illustrated in FIG. 7, with the locking pins 186 in an outwardly projected position and engaging the rim 212 of the recess 210. The wear bushing 152 is further secured to the tool 150 at this point by the C-ring 206 which, due to its natural radial-inward bias, will tend to grip the upper portion of the tool body 162. The tool 150 is lowered into the wellbore until the wear bushing 152 becomes seated within the casing hanger (not shown). During seating, the locking dogs 196 engage and become secured within a complimentary profile on the wellhead (not shown).

Additional weight or downward force upon the drill string will cause the C-ring 206 to be urged radially outwardly into the recess 204 by camming engagement with portions of the tool body 162 outward of shafts 168. The C-ring 206 is preferably a "weak" C-ring, meaning that it will tend to disengage the tool body 162 before the locking dogs 196 are disengaged from the wellhead.

As the tool 150 is moved further downwardly with respect to the bushing 152, the locking pins 186 are cammed inwardly by the lower camming surface 214 of the recess 210. When the pins 186 become radially withdrawn, the shaped portions 182 of the dog capture pins 174 are urged downwardly by gravity and by the compressive springs 185 to drop down into the recesses 188 of the locking pins 186 and maintain the locking pins 186 in a radially withdrawn configuration. The drill string may now be used for drilling below the wear bushing 152, with tool 150 remaining in the drill string.

If it is desired to remove the drill bit without removing housing 190 of the wear bushing 152, this may be done by directly pulling the drill string up and out of the wellbore. The locking pins 186 will remain in a radially withdrawn configuration due to disposal of the dog capture pins 174 within the recesses 188 on the locking pins. However, as the tool body 154 is pulled upwardly, the trigger pins 172 will engage the inwardly-directed shoulder 197 of the locking assembly 194. As a result, the locking assembly 194 will be lifted off of the housing 190 removing it from the wellbore.

If it is desired to also remove the housing 190 of the wear bushing 152, the operator will need to pull the drill string upward to a point where the trigger pins 172 engage the inwardly-directed shoulder 197 of the locking assembly 194 and stop pulling upwardly. The engagement of the trigger pins 172 with the locking assembly 194 will provide a weight indication to an operator at the surface indicating that such engagement has occurred.

Engagement with the shoulder 197 will cause the trigger pins 172 to be cammed inwardly, and the upper camming surface 180 of each trigger pin 172 will compress the spring 185 above it, thereby urging the dog capture pin 174 upwardly within its shaft 168 and removing the dog capture pin 174 from its respective recess 188 in locking pin 122 to free the locking pin 122 to become projected radially outwardly. At this point, the tool 150 can be moved downwardly with respect to the wear bushing 152 until the locking pins 122 are moved adjacent the recess 210 and move radially outwardly into the recess 210. A slight rotation of the drill string may be necessary to orient the tool body 154 so that the locking pins 122 become aligned with the recesses 210 in the wear bushing 252. If the drill string and tool 150 are pulled upwardly at this point, the locking pins 186 will engage the rim 212 of the recess 210 and the housing 190 of the wear bushing 152 will be pulled out of the casing hanger along with the tool 150.

Figure 8:
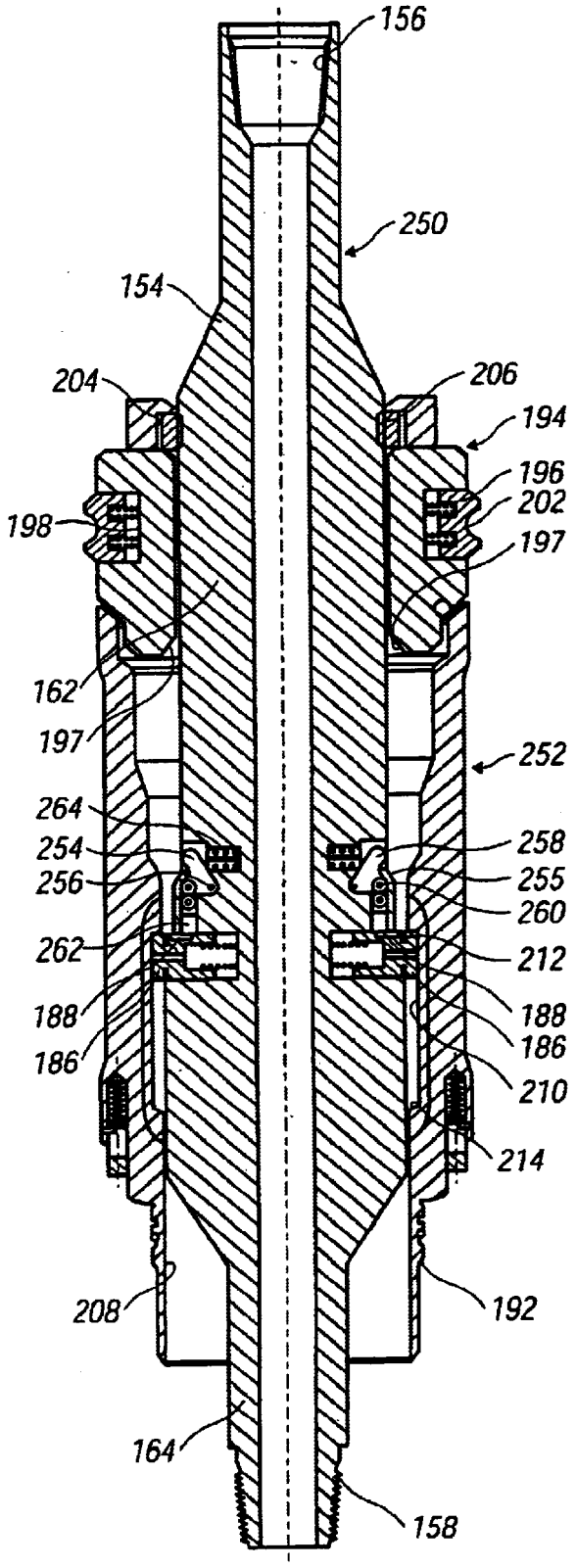
FIG. 8 is a side cross-sectional view of a further alternative exemplary tool and wear bushing.

Referring now to FIG. 8, a cross-sectional view is provided of a further exemplary embodiment for a running and receiving tool 250 and associated wear bushing 252. This tool, like the tool 150 described previously, also relies upon mechanical manipulation rather than hydraulic actuation to operate. The tool is similar in many respects to the tool 150 that was described earlier. Therefore, like reference numerals will be used to designate like components.

The tool 250 does not have shafts 186 or any of the pins 172, 174 maintained therein. Instead, the upper reduced diameter portion 162 of the tool body 154 carries a set of pivot and lever components located just above the locking pins 186 that are used to selectively engage the recesses 188 on the upper surface of each locking pin 186, thereby securing it in a radially reduced configuration. The pivot and lever components include an L-shaped member 254 that is affixed at a pivot point 256 to the tool body 154. One end of the L-shaped member 254 presents a camming shoulder 258, while the other end of the L-shaped member 254 is affixed by means of pins and rollers 260 to a capture bar 262. The capture bar 262 has a lower end that is shaped and sized to reside within the recess 188 on the upper surface of a locking pin 186. The ends of the L-shaped members 254 with the camming shoulders 258 are normally biased outwardly by springs 264 that are disposed in the tool body 154. It is further noted that an upwardly and outwardly directed shoulder 255 is formed by a reduction in diameter in the tool body 154. This shoulder is located slightly below the camming shoulders 258 of the L-shaped members 254.

Prior to operation, the wear bushing 252 is secured to the tool body 154 as illustrated in FIG. 8. The locking pins 186 are radially outwardly extended and reside within the recess 210 to secure the wear bushing 252 to the tool 250 in a manner previously described.

The tool 250 is then lowered into the wellbore and the wear bushing 252 is seated into the casing hanger (not shown) as described previously. Once the wear bushing 252 is seated, the tool 250 can be further lowered into the wellbore by adding weight or a downward force upon the drill string so that the tool 250 becomes released from the wear bushing 252. Upon application of such weight or force, the ring 206 releases the tool body 154. Recess shoulder 214 cams pins 186 inward. Capture bars 262 engage recess 188 to hold pins 186 in the inward position. Drilling can then be conducted.

If it is desired to remove the drill bit from the wellbore and leave the housing 190 of the wear bushing 252 in place within the casing hanger, this may be done by pulling the drill string straight out until the drill bit is removed. Pins 186 remain contracted. The upwardly and outwardly directed shoulder 255 of the tool body 154 engages the shoulder 197 of the locking assembly 194. As a result, the locking assembly 194 will be lifted off of the housing 190 as the drill string is pulled upward and removed from the wellbore. A sufficient pull causes dogs 196 to retract.

If it is desired to remove the drill bit and also retrieve the housing 190 of the wear bushing 252, this is accomplished by raising the drill string to the point where the camming shoulders 258 of the L-shaped pieces engage the shoulder 197 of the wear bushing g 252. The shoulder 197 will urge the camming shoulders 258 radially inwardly, compressing the springs 264. The L-shaped member 254 is pivoted about the pivot point 256 and, thus, exerts an upward pull on the bar 262, removing it from the recess 188 in the locking pin 186. As a result, the locking pins 186 are freed for radial outward movement. The wear bushing 252 can now be latched into by lowering the drill string until the locking pins 186 are aligned with the recess 210 of the wear bushing 252. A slight rotation of the drill string may be necessary to orient the tool body 154 so that the locking pins 186 become aligned with the recesses 210 in the wear bushing 252. The drill string can then be pulled upwardly bringing the housing 190 of the wear bushing 252 with it.

While the invention has been shown in only some of its forms, it should be apparent to those skilled in the art that it is not so limited, but is susceptible to various changes without departing from the scope of the invention.

What is claimed is:

1. An assembly for running and retrieving a wear bushing comprising:

a tool body for incorporation into a drill string, the tool body having an outer diameter that is sized to pass through the interior diameter of a wear bushing to be carried by the tool body;

a gripping member on the tool body for selectively engaging a radially interior portion of a wear bushing; and wherein the gripping member comprises a radially expandable C-ring to reside within a recess in a wear bushing.

2. The running and retrieving assembly of claim 1 further comprising:

a collar disposed atop portions of the tool body;

a fluid chamber defined between the collar and the tool body;

a fluid flowbore defined centrally within the tool body, the fluid flow bore being in fluid communication with the fluid chamber; and wherein the C-ring may be selectively radially expanded to reside within the recess of a wear bushing by varying fluid pressure within the fluid flowbore and fluid chamber.

3. An assembly for running and retrieving a wear bushing comprising:

a tool body having a longitudinal flowbore defined therein;

the tool body having an enlarged diameter portion that is sized to pass entirely through a central opening in a wear bushing to be run and retrieved;

an engagement member that is moveable with respect to the tool body, the engagement member being operable to selectively engage a portion of a wear bushing to carry it upon the tool body; and wherein the engagement member comprises a radially expandable C-ring having an upper annular recess to engage a downward protrusion within a recess of a wear bushing, thereby securing the wear bushing onto the tool body.

4. A method of removably running a wear bushing within a wellhead comprising:

reversably latching a wear bushing to a tool body that is incorporated within a drill string;

disposing the drill string within a wellbore;

lowering the drill string within the wellbore to seat the wear bushing within a wellhead for the wellbore;

continuing to lower the drill string within the wellbore to disengage the tool body from the wear bushing;

raising the drill string within the wellbore;

selectively engaging the wear bushing with the tool body;

further withdrawing the drill string from the wellbore to remove the wear bushing from the wellhead; and wherein the operation of selectively engaging the wear bushing with the tool body comprises engaging a portion of the wear bushing with a radially expandable C-ring carried on the tool body.

5. The method of claim 4 wherein the step of the step of selectively engaging the wear bushing with the tool body further comprises the step of providing a weight indication to an operator at the surface that the tool body is engaged with the wear bushing so that the wear bushing may be removed from the wellhead.

6. The method of claim 4 wherein the operation of selectively engaging the wear bushing with the tool body comprises engaging a portion of the wear bushing with a radially projecting locking pin carried on the tool body.

7. A wear bushing assembly, comprising:

a tool body for incorporation into a drill string;

a wear bushing having a bore that receives the tool body, the wear bushing having an outer diameter dimensioned to land within a wellhead assembly;

a latching member on the outer diameter of the wear bushing for selectively locking the wear bushing within the wellhead assembly; and a radially expandable ring that resides within a recess and provides an engagement between the tool body and the bore of the wear bushing to releasably secure the wear bushing to the tool body as the wear bushing is being lowered into the wellhead assembly, the ring releasing the tool body from the wear bushing after the wear bushing lands in the wellhead assembly to enable the drill string to be lowered further into the well for performing drilling operations.

8. A method of removably running a wear bushing within a wellhead comprising:

reversably latching a wear bushing to a tool body that is incorporated within a drill string;

disposing the drill string within a wellbore;

lowering the drill string within the wellbore to seat the wear bushing within a wellhead for the wellbore;

continuing to lower the drill string within the wellbore to disengage the tool body from the wear bushing;

raising the drill string within the wellbore;

selectively engaging the wear bushing with the tool body;

further withdrawing the drill string from the wellbore to remove the wear bushing from the wellhead; and wherein the operation of selectively engaging the wear bushing with the tool body comprises engaging a portion of the wear bushing with a radially expandable ring.

* * * * *